US009075378B2

(12) United States Patent
Ishida et al.

(10) Patent No.: US 9,075,378 B2
(45) Date of Patent: Jul. 7, 2015

(54) FIXING DEVICE AND IMAGE FORMING APPARATUS WITH HEATED FIXING DEVICE EXIT ROLLERS

(75) Inventors: Masami Ishida, Kanagawa (JP); Shigeru Watanabe, Kanagawa (JP); Kiichirou Arikawa, Kanagawa (JP); Yoshiro Konishi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 302 days.

(21) Appl. No.: 13/279,623

(22) Filed: Oct. 24, 2011

(65) Prior Publication Data

US 2012/0251200 A1 Oct. 4, 2012

(30) Foreign Application Priority Data

Mar. 29, 2011 (JP) ..... 2011-072224

(51) Int. Cl.
*G03G 15/00* (2006.01)
*G03G 15/20* (2006.01)

(52) U.S. Cl.
CPC ..... *G03G 15/6573* (2013.01); *G03G 15/2085* (2013.01); *G03G 15/2028* (2013.01)

(58) Field of Classification Search
CPC ..... G03G 15/6573; G03G 15/2085
USPC ..... 399/322, 405, 406
See application file for complete search history.

(56) References Cited

U.S. PATENT DOCUMENTS 6,898,388 B2 5/2005 Uehara et al.
7,176,952 B2 * 2/2007 Ishida et al.
2003/0063937 A1 * 4/2003 Nomura ..... 399/405
2004/0057741 A1 3/2004 Uehara et al.
2005/0069340 A1 * 3/2005 Noda et al.
2011/0064502 A1 * 3/2011 Hase et al. ..... 399/406

FOREIGN PATENT DOCUMENTS

JP A-04-299369 10/1992
JP 2002162851 A * 6/2002 ..... G03G 15/20
JP A-2002-365967 12/2002
JP A-2004-139040 5/2004
JP 2006-078745 A 3/2006
JP 2008151925 A * 7/2008
JP A-2008-151925 7/2008

OTHER PUBLICATIONS

Dec. 2, 2014 Office Action issued in Japanese Application No. 2011-072224.

* cited by examiner

*Primary Examiner* — David Gray
*Assistant Examiner* — Laura Roth
(74) *Attorney, Agent, or Firm* — Oliff PLC

(57) ABSTRACT

Provided is a fixing device that includes a first rotating member that rotates while pinching a sheet which holds an image on a first surface of the sheet and is transported, fixes the image to the sheet, and heats the image while coming into contact with the first surface. Further provided is a second rotating member that comes into contact with a second surface that is a back surface of the first surface, a third rotating member that guides the sheet by rotating while coming into contact with the first surface of the sheet fed from a gap between the first and second rotating members, and a support member that supports the first, second, and third rotating members with a space through which the heat of the first rotating member is transferred to the third rotating member interposed between the first and third rotating members.

6 Claims, 7 Drawing Sheets

FIXING DEVICE AND IMAGE FORMING APPARATUS WITH HEATED FIXING DEVICE EXIT ROLLERS

CROSS-REFERENCE TO RELATED APPLICATIONS

This application is based on and claims priority under 35 USC 119 from Japanese Patent Application No. 2011-072224 filed Mar. 29, 2011.

BACKGROUND (i) Technical Field

The present invention relates to a fixing device and an image forming apparatus.

(ii) Related Art

The following devices are known as a fixing device that fixes an image to a sheet by heating the sheet on which the image has been formed.

SUMMARY

According to an aspect of the invention, there is provided a fixing device that includes a first rotating member that rotates while pinching a sheet which holds an image on a first surface of the sheet and is transported, fixes the image to the sheet, and heats the image while coming into contact with the first surface; a second rotating member that comes into contact with a second surface that is a back surface of the first surface; a third rotating member that guides the sheet by rotating while coming into contact with the first surface of the sheet fed from a gap between the first and second rotating members; and a support member that supports the first, second, and third rotating members with a space through which the heat of the first rotating member is transferred to the third rotating member interposed between the first and third rotating members.

BRIEF DESCRIPTION OF THE DRAWINGS

Exemplary embodiments of the present invention will be described in detail based on the following figures, wherein.

DETAILED DESCRIPTION

An exemplary embodiment of the invention will be described below.

Figure 1:
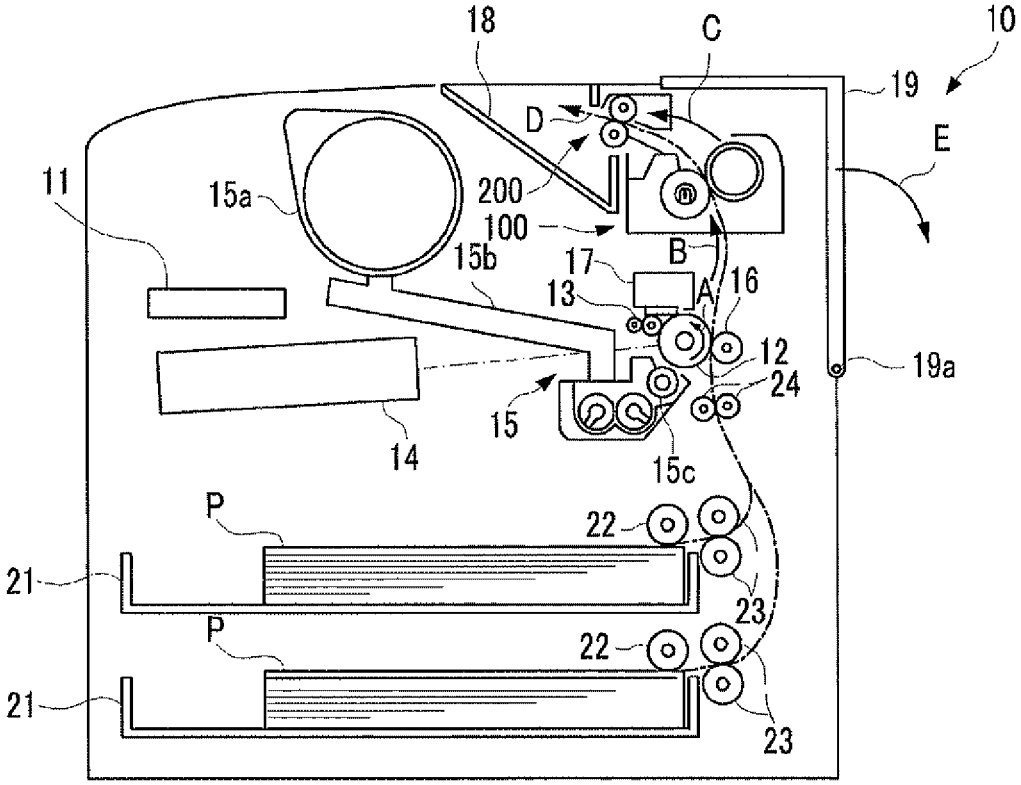
FIG. 1 is a schematic configurational diagram of a printer as an image forming apparatus according to an exemplary embodiment of the invention.

FIG. 1 is a schematic configurational diagram of a printer as an image forming apparatus according to an exemplary embodiment of the invention.

A fixing device according to an exemplary embodiment of the invention is assembled in the printer shown in FIG. 1.

An image signal, which is generated outside a printer 10 and represents an image, is input to the printer 10 through a signal cable (not shown) or the like. The printer 10 is provided with a controller 11 that controls the movement of each component of the printer 10, and an image signal is input to the controller 11. Further, the formation of an image based on the image signal is performed under the control of the controller 11 in the printer 10.

Two sheet trays 21 are housed in the lower portion of the printer 10. Sheets P, which have different dimensions corresponding to the respective sheet trays 21, are stored in these sheet trays 21 while being stacked. Each of the sheet trays 21 is adapted so as to be capable of being freely drawn for the purpose of the replenishment of sheets P.

Sheets P, which have dimensions corresponding to the dimensions of the image represented by the image signal input to the controller 11, are fed from one sheet tray of these two sheet trays 21 by a pickup roll 22. The fed sheets P are separated one by one by retard rolls 23, and the separated one sheet P is transported upward, and the leading edge of the sheet P reaches standby rolls 24. The standby rolls 24 function to adjust the transport timing after themselves and to feed a sheet P. The transport timing of the sheet P, which reaches the standby rolls 24, after the standby rolls is adjusted by the standby rolls 24, and the sheet P is further transported.

The printer 10 includes a photoreceptor 12 that is provided above the standby rolls 24 and rotates in a direction indicated by an arrow A. Further, a charger 13, an exposure unit 14, a developer unit 15, a transfer unit 16, and a cleaner 17 are disposed around the photoreceptor 12.

The photoreceptor 12 has a cylindrical shape, retains electrical charges by charging, and discharges the electrical charges by exposure, so that an electrostatic latent image is formed on the surface of the photoreceptor 12.

The charger 13 charges the surface of the photoreceptor 12 to a certain charged potential.

Further, an image signal is input to the exposure unit 14 from the controller 11. Furthermore, exposure light, which is modulated in accordance with the image signal, is output from the exposure unit 14. The photoreceptor 12 is subjected to the exposure performed by the exposure light, so that an electrostatic latent image is formed on the surface of the photoreceptor 12.

In addition, after the photoreceptor 12 is subjected to exposure by exposure light and an electrostatic latent image is formed on the surface of the photoreceptor 12, the electrostatic latent image is developed by the developer unit 15. The developer unit 15 includes a toner storage section 15*a*, a toner supply passage 15*b*, and a developing roller 15*c*. In the developer unit 15, toner stored in the toner storage section 15*a* is fed to the vicinity of the developing roller 15*c* through the toner supply passage 15*b*. Further, toner is supplied to the photoreceptor 12 by the developing roller 15*c* and development is performed, so that a toner image is formed on the surface of the photoreceptor 12.

Here, the standby rolls 24 feed a sheet P so that the sheet P reaches a position facing the transfer unit 16 at the timing where the toner image formed on the photoreceptor 12 reaches a position facing the transfer unit 16. Further, the toner image formed on the photoreceptor 12 is subjected to the operation of the transfer unit 16 and transferred to the fed sheet P.

A section, which includes the photoreceptor 12, the charger 13, the exposure unit 14, the developer unit 15, and the transfer unit 16, corresponds to an example of an image forming section of the invention.

The toner, which remains on the photoreceptor 12 after the transfer of the toner image, is removed from the photoreceptor 12 by the cleaner 17.

The sheet P to which the toner image has been transferred further advances in the direction of an arrow B and is heated and pressed by a fixing unit 100, so that an image formed of a fixed toner image is formed on the sheet P.

The sheet P, which has passed through the fixing unit 100, advances toward a discharger 200 in the direction of an arrow C, is further fed in the direction of an arrow D by the discharger 200, and is discharged onto a sheet discharge table 18.

Moreover, in the printer 10, a rear panel 19, which covers the fixing unit 100 and the discharger 200, rotates about a fulcrum 19*a* in the direction of an arrow E so as to be opened.

In this exemplary embodiment, each of the fixing unit 100 and the discharger 200 is unitized. Accordingly, each of the fixing unit 100 and the discharger 200 is attached to or detached from the printer 10 through an opening portion that appears when the rear panel 19 is opened. For example, when the fixing unit 100 or the discharger 200 deteriorates, it can be replaced with a new one. The fixing unit 100 corresponds to an example of a fixing device of the invention. Further, the fixing unit 100 also corresponds to an example of a fixing section of an image forming apparatus of the invention.

Furthermore, when a sheet P is jammed between the fixing unit 100 and the discharger 200, the rear panel 19 is opened and the jammed sheet P is removed by a user.

Figure 2:
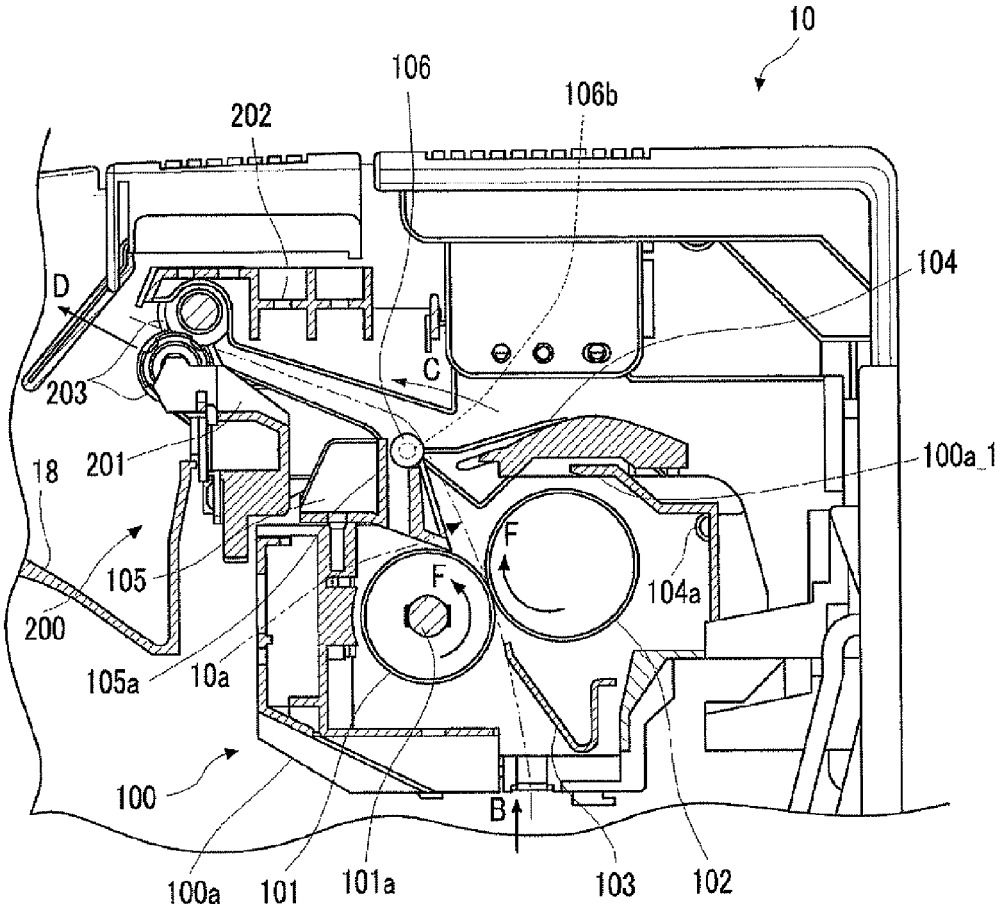
FIG. 2 is a view showing the cross-section of a fixing unit and a discharger of the printer shown in FIG. 1.

FIG. 2 is a view showing the cross-section of the fixing unit and the discharger of the printer shown in FIG. 1.

The fixing unit 100 includes a heating roll 101 and a pressure roll 102. The heating roll 101 has a cylindrical shape and includes a heat source 101*a* therein. The peripheral surface of the pressure roll 102, which also has a cylindrical shape, is pressed against the peripheral surface of the heating roll 101. The sheet, which advances in the direction of the arrow B and reaches the fixing unit 100, is guided to a contact portion between the pressure roll 102 and the heating roll 101 by the sheet guide 103. The sheet is pinched between heating roll 101 and the pressure roll 102 at the contact portion. At this time, while the surface of the sheet on which the toner image has been formed faces the heating roll 101, the sheet is pinched between the heating roll 101 and the pressure roll 102.

The heating roll 101 and the pressure roll 102 rotate in the direction of an arrow F while coming into contact with each other. For this reason, the sheet guided to the contact portion is pinched between the heating roll 101 and the pressure roll 102 at the contact portion, and advances toward the discharger 200. Further, at that time, the sheet is heated by the heating roll 101 and pressed by the pressure roll 102, so that an image formed of a fixed toner image is formed on the sheet.

The heating roll 101 corresponds to an example of a first rotating member of the invention and the pressure roll 102 corresponds to an example of a second rotating member of the invention.

The fixing unit 100 includes a frame 100*a* that supports the heating roll 101 and the pressure roll 102 so as to allow the heating roll 101 and the pressure roll 102 to be freely rotatable. Further, in the fixing unit 100, a cover 104, which covers the contact portion between the heating roll 101 and the pressure roll 102, is mounted on the frame 100*a* so as to be freely opened and closed about a fulcrum 104*a* of the frame 100*a*. The cover 104 is closed while a portion of the cover 104 facing the contact portion hits against an extension portion 100*a*_1 of the frame 100*a* of the fixing unit 100 extending above the pressure roll 102.

Further, the frame 100*a* of the fixing unit 100 is provided with the following guide frame 105. The guide frame 105 extends above the heating roll 101 on the downstream side of the contact portion between the heating roll 101 and the pressure roll 102 in a transporting direction, and functions to guide the sheet having passed through the contact portion to the discharger 200. The sheet having come out of the contact portion between the heating roll 101 and the pressure roll 102 is guided to the guide frame 105, pushes up the leading edge of the cover 104, and advances toward the discharger 200 in the direction of the arrow C.

Here, a transporting path 10*a*, which passes by the fixing unit 100 and the discharger 200, is bent toward the discharger 200 in the vicinity of the leading edge of the cover 104 as shown by a dashed dotted line in FIG. 2. Further, rollers 106 are disposed at the bent corner of the transporting path 10*a*.

Each of the rollers 106 includes rotating shafts 106*b* that intersect with the transporting direction of a sheet and extend along the direction along the sheet. Moreover, the rotating shafts 106*b* of the roller 106 are rotatably supported by the guide frame 105 at the bent corner of the transporting path 10*a*. In addition, the rollers 106 are supported by the guide frame 105 so that a part of the peripheral surface of each roller 106 protrudes to the inside of the transporting path 10*a* as compared to the guide frame 105.

A sheet is transported along the transporting path 10*a* so that the surface of the sheet on which a toner image has been formed faces the rollers 106. Since a part of the peripheral surface of each roller 106 protrudes to the inside of the transporting path 10*a* as compared to the guide frame 105, a sheet passing along the transporting path 10*a* comes into contact with the rollers 106. When a sheet comes into contact with the rollers 106, the rollers 106 rotate with the movement of the sheet.

If the rollers 106 are not disposed at the bent corner of the transporting path 10*a*, there is a concern that a sheet may come into contact with the corner of the guide frame 105 at the bent corner. The surface of a sheet on which a toner image has been formed faces the guide frame 105. For this reason, if a sheet comes into contact with the corner of the guide frame 105, there is a concern that the toner image may be damaged due to the friction between the sheet and the corner of the guide frame 105.

In this exemplary embodiment, a sheet, which is close to the corner of the guide frame 105 on the transporting path 10*a*, comes into contact with the peripheral surfaces of the rollers 106 as described above. Further, since the rollers 106 with which a sheet comes into contact rotate with the movement of the sheet, there is a low possibility that the toner image may be damaged due to the friction between the sheet and the peripheral surfaces of the rollers 106. As described above, in this exemplary embodiment, due to the rotation of the rollers 106, a sheet is smoothly transported at the bent corner of the transporting path 10*a* while suppressing the generation of the damage to a toner image.

The rollers 106 correspond to an example of a third rotating member of the invention.

Here, in this exemplary embodiment, the guide frame 105 includes ducts 105*a* that support the rollers 106 and are opened toward the heating roll 101 above the heating roll 101. Each of the rollers 106 is supported by the upper portion of the duct 105*a* that is opposite to the heating roll 101, and each of the rollers 106 is exposed to the internal space of the duct 105*a*.

The heating roll 101 generates heat when a toner image is to be fixed. Further, the heat generated by the heating roll 101 is transferred to the rollers 106 as radiant heat through the internal spaces of the ducts 105*a*, and the rollers 106 are heated by the radiant heat. Furthermore, air around the heating roll 101 is heated by the heat generated by the heating roll 101. The heated air ascends up to the rollers 106 through the internal spaces of the ducts 105*a* due to the convection. Moreover, the rollers 106 are heated even by this air. As described above, each of the rollers 106 is supported with a space, through which the heat of the heating roll 101 is transferred to the roller 106, interposed between the heating roll 101 and itself.

The frame 100*a* of the fixing unit 100, which is provided with the guide frame 105 including the ducts 105*a*, corresponds to an example of a support member of the invention.

Here, a space through which the heat of the heating roll 101 is transferred to each roller 106, like the internal space of the duct 105*a*, may not be formed between the roller 106 and the heating roll 101. As described above, the sheet, which is fed from a gap between the heating roll 101 and the pressure roll 102, comes into contact with the rollers 106. At this time, the toner image, which is formed on the sheet, still sufficiently retains the heat applied from the heating roll 101. If the above-mentioned space is not formed between each roller 106 and the heating roll 101, the temperature of the roller 106 is significantly lower than that of the toner image formed on the sheet. For this reason, when the sheet fed from a gap between the heating roll 101 and the pressure roll 102 comes into contact with the rollers 106, the heat of the toner image formed on the sheet is absorbed by the rollers 106. As a result, temperature unevenness occurs between a portion of the toner image where each roller 106 comes into contact with the sheet and a portion of the toner image where each roller 106 does not come into contact with the sheet, and the temperature unevenness causes gloss unevenness on the cooled toner image.

In this exemplary embodiment, the heat of the heating roll 101 is transferred to the rollers 106 through the internal spaces of the ducts 105*a* and the rollers 106 are heated by the transferred heat. For this reason, temperature difference between the roller 106 and the toner image formed on the sheet is suppressed. Furthermore, even though the sheet fed from a gap between the heating roll 101 and the pressure roll 102 comes into contact with the rollers 106, the absorption of heat from the toner image to the rollers 106 is suppressed. As a result, the occurrence of gloss unevenness on the toner image is suppressed.

The rollers 106 and the ducts 105*a* will be described below again.

The sheet, which has passed through the bent corner where the rollers 106 are disposed, enters the discharger 200.

The discharger 200 includes a lower frame 201 that functions as a lower guide of the transporting path 10*a* and an upper frame 202 that functions as an upper guide.

Further, sheet discharge rolls 203, which continue to feed the sheet having entered the discharger 200 on the transporting path 10*a* in the direction of the arrow C and further feed the sheet in the direction of the arrow D, are supported by the lower frame 201. The sheet is transported along the transporting path 10*a* in the direction of the arrow D by the sheet discharge rolls 203, and is discharged onto the sheet discharge table 18.

Figure 3:
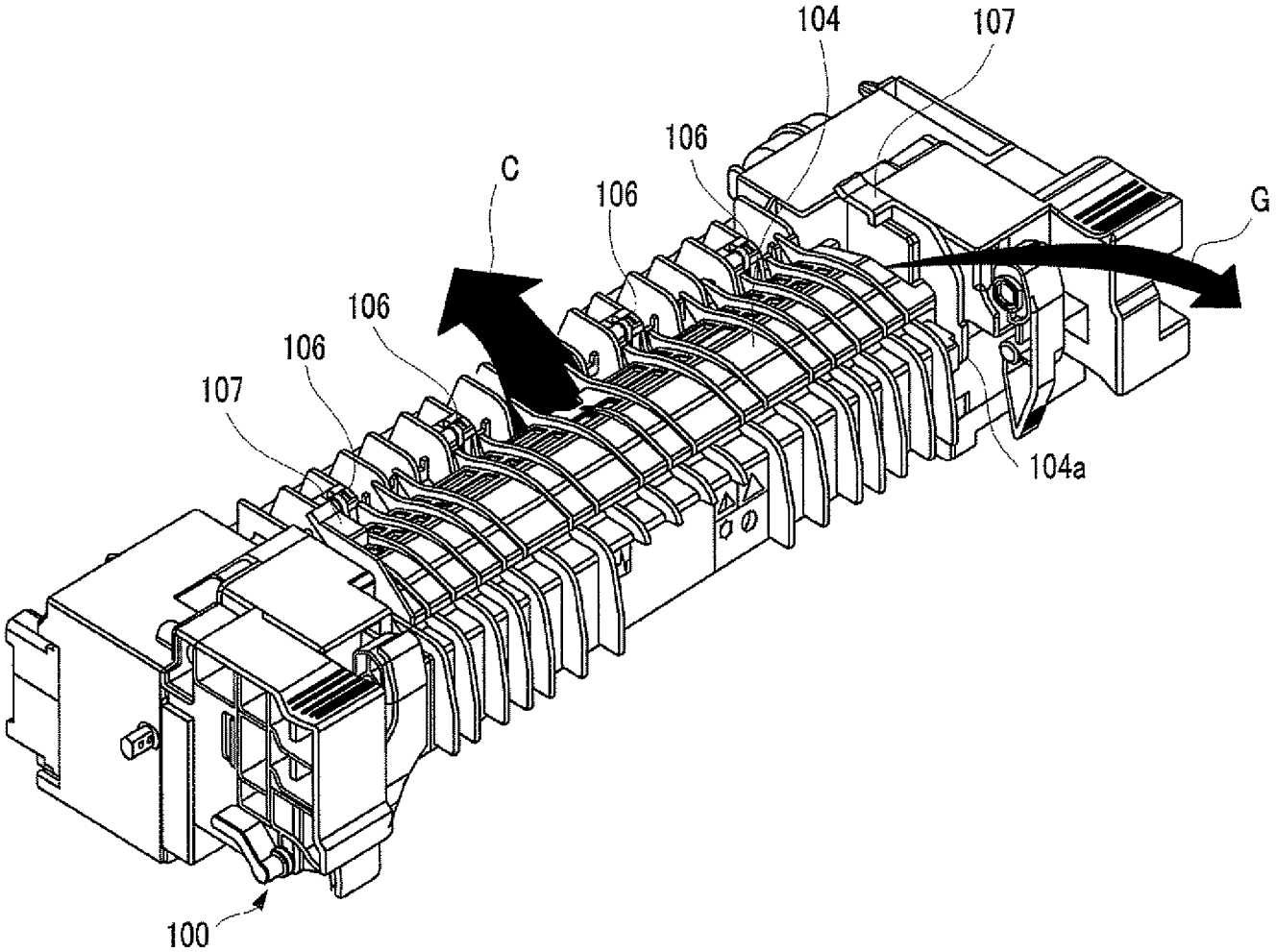
FIG. 3 is a perspective view of the appearance of the fixing unit of which the cross-section is shown in FIG. 2, when seen from the upper side of a cover.

FIG. 3 is a perspective view of the appearance of the fixing unit of which the cross-section is shown in FIG. 2, when seen from the upper side of the cover.

The sheet having come out of the fixing unit 100 pushes up the leading edge of the cover 104 on the transporting path 10*a*, advances in the direction of the arrow C, and enters the discharger 200. As described above, the transporting path 10*a* is bent toward the discharger 200 in the vicinity of the leading edge of the cover 104 and the rollers 106 are disposed at the bent corner of the transporting path 10*a*. In this exemplary embodiment, four rollers 106 are disposed side by side at the bent corner in the width direction of a sheet.

Here, when a sheet P is jammed between the fixing unit 100 and the discharger 200 in the printer 10, the rear panel 19 is opened by a user as described with reference to FIG. 1. Further, the user puts a hand into the printer 10 and removes the jammed sheet. The cover 104 of the fixing unit 100 is rotatable about the fulcrum 104*a* as described above. Accordingly, when the sheet is to be removed, the cover 104 is rotated about the fulcrum 104*a* and opened by the user.

As shown in FIG. 3, operating levers 107, which are used to open the cover 104 in the direction of an arrow G by a user intending to remove the jammed sheet, are mounted at both end portions of the cover 104 in the fixing unit 100.

Figure 4:
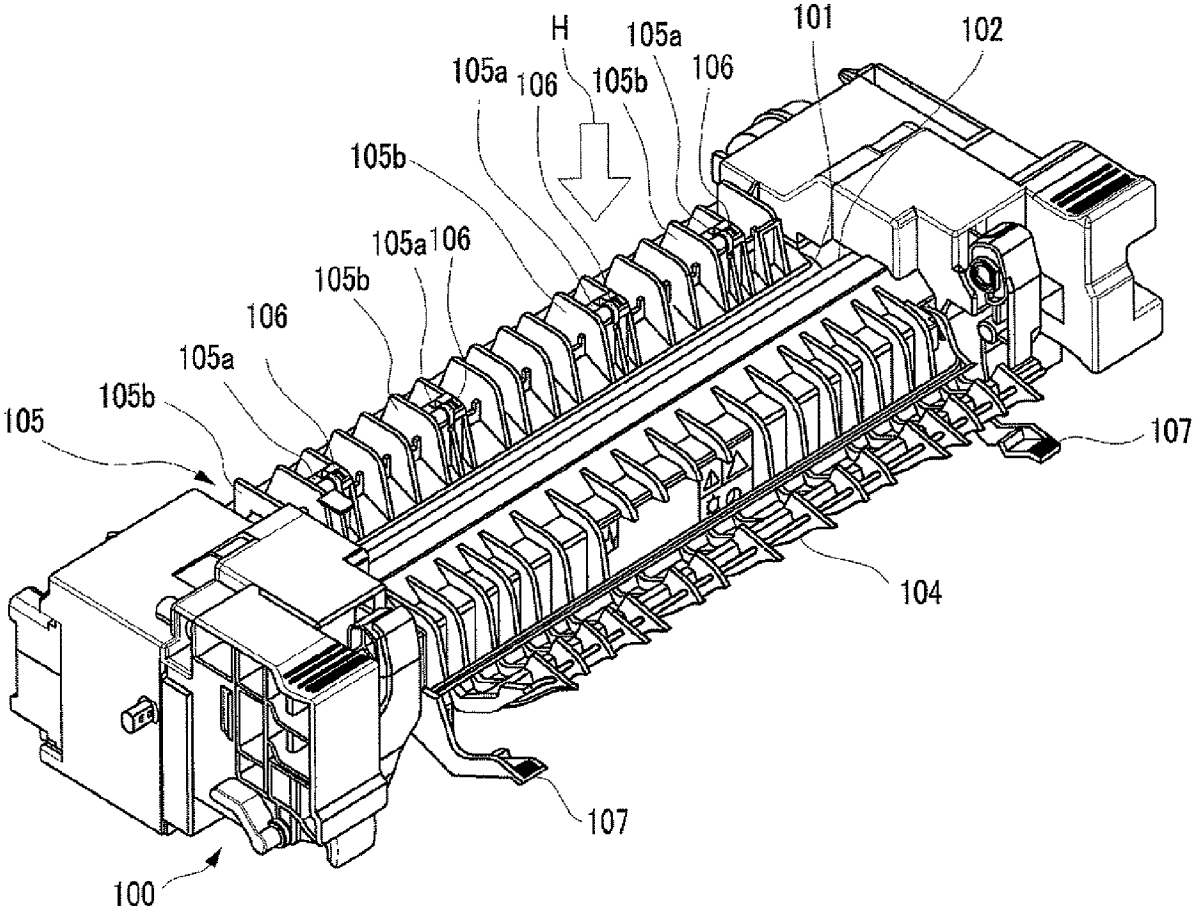
FIG. 4 is a perspective view of the appearance of the fixing unit of which a cover is opened, when seen from the same direction as the direction in FIG. 3.

FIG. 4 is a perspective view of the appearance of the fixing unit of which a cover is opened, when seen from the same direction as the direction in FIG. 3.

When a user operates the operating levers 107 and opens the cover 104, a portion of the transporting path 10*a* shown in FIG. 2, which is formed between the discharger 200 and the contact portion between the heating roll 101 and the pressure roll 102, is exposed to the outside. While exposing the transporting path to the outside in this way, a user removes a jammed sheet.

Here, in FIG. 4, the cover 104 is opened, so that the structure of the guide frame 105 around the roller 106 is also exposed to the outside.

The guide frame 105 includes plural ribs 105*b* that guides a sheet in the direction of the arrow C of FIG. 3 and has the shape of a trapezoidal plate. Further, four ducts 105*a*, each of which supports one roller 106 and is opened toward the heating roll 101 as shown in FIG. 2, are formed at the guide frame 105. Each of the ducts 105 is interposed between two ribs 105*b*. Each roller 106 is supported by the upper portion of each duct 105*a*.

The four rollers 106 of this exemplary embodiment correspond to an example of plural rolls of the invention, and the ducts 105*a* formed at four positions correspond to an example of plural pipelines of the invention.

In this exemplary embodiment, the respective four rollers 106 come into contact with a sheet, rotate, and guide the sheet to the downstream side. The rotating members, which guide a sheet, are not limited to these four rollers 106. For example, one roll body, which extends in the width direction of a sheet, or the like, may also be considered as the rotating members. Since the contact area between a sheet and the four rollers 106 of this exemplary embodiment is smaller than that between a sheet and this one roll body, the four rollers 106 can further suppress the occurrence of gloss unevenness.

Further, the spaces between the heating roll 101 and the four rollers 106 are not limited to the internal spaces of the respective ducts 105*a* that are formed for the respective rollers 106, and one space, which extends between the four rollers 106 and the heating roll 101, or the like may also be considered as the spaces. When heat is transferred to the four rollers 106 through the above-mentioned one space, for example, there is a possibility that air heated by the heat of the heating roll 101 may not necessarily be directed to the rollers 106 and is diffused to the periphery. In this exemplary embodiment, air entering the internal spaces of the ducts 105*a* ascends up to the rollers 106 in the internal spaces without being diffused. As a result, in this exemplary embodiment where heat is transferred to the respective rollers 106 through the internal spaces of the ducts 105*a*, the rollers 106 are more reliably heated by the convection of the heated air as compared to a case where heat is transferred to the respective rollers 106 through the above-mentioned one space.

Figure 5:
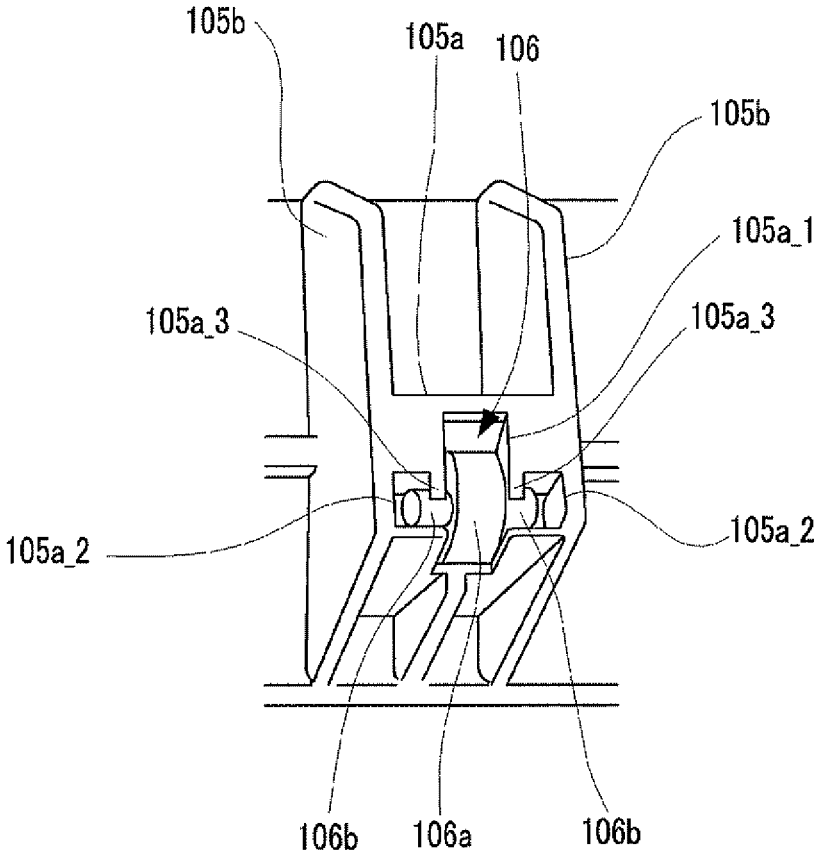
FIG. 5 is an enlarged view of the upper portion of a duct where one roller is supported, when seen from the direction of an arrow H shown in FIG. 4.

FIG. 5 is an enlarged view of the upper portion of the duct where one roller is supported, when seen from the direction of an arrow H shown in FIG. 4.

Figure 6A:
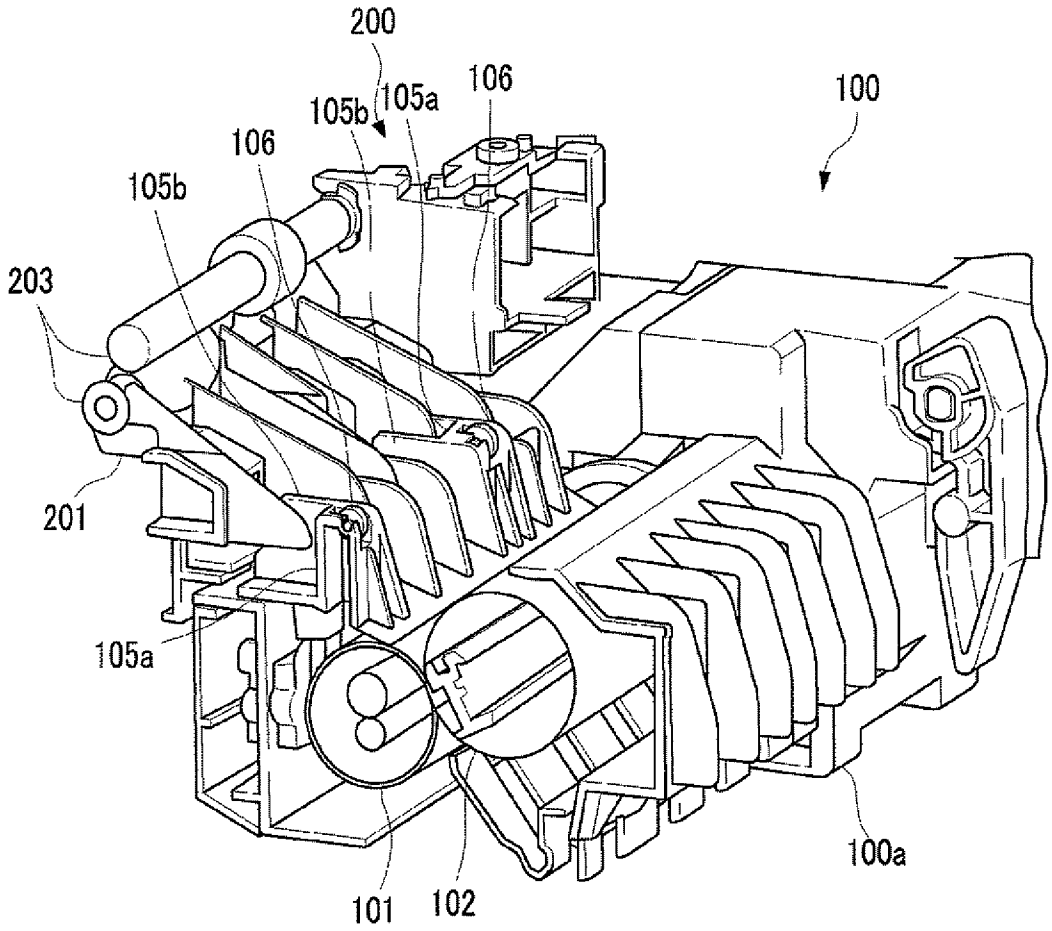
FIGS. 6A and 6B are perspective views of the fixing unit, which is cut at a cutting plane passing across a rotating shaft of a roller, when the cross-section is seen toward the near side.
Figure 6B:
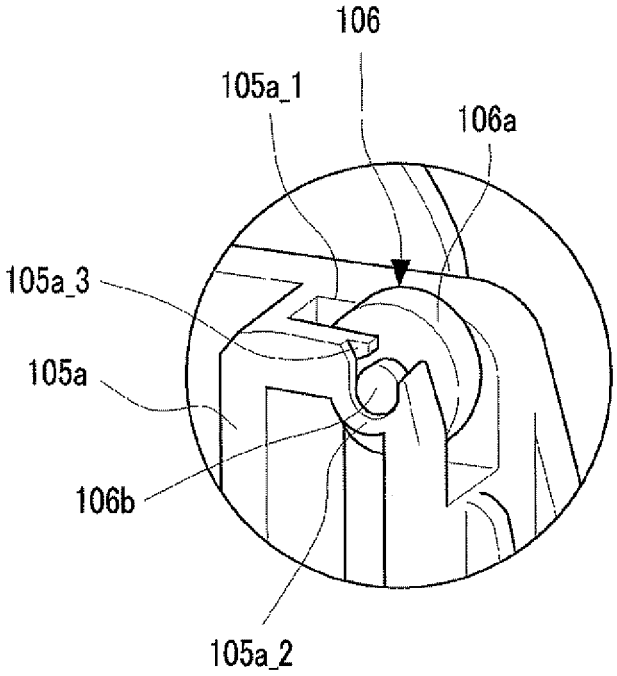

FIGS. 6A and 6B are perspective views of the fixing unit, which is cut at a cutting plane passing across a rotating shaft of a roller, when the cross-section is seen toward the near side. Meanwhile, for ease of understanding, the cover 104 is removed from the fixing unit 100 in FIGS. 6A and 6B. Accordingly, the contact portion between the heating roll 101 and the pressure roll 102 is exposed to the outside.

The fixing unit 100, the lower frame 201 of the discharger 200, and the sheet discharge rolls 203 are shown in FIG. 6A. Further, an enlarged view of the structure around the roller 106 on the cross-section is shown in FIG. 6B.

The rollers 106 and the ducts 105*a* will be described below with reference to FIGS. 5, 6A and 6B.

Each of the rollers 106 includes a disc-shaped roller body 106*a*. Further, the rotating shafts 106*b* protrude from the centers of two circular side surfaces of the roller body 106*a*.

The appearance of the duct 105*a* is formed in the shape of a post interposed between two ribs 105*b*. An opening 105*a*_1 to which the roller body 106*a* of the roller 106 is fitted is formed from the end face of the upper portion of the duct to the corner of the duct close to the contact portion between the heating roll 101 and the pressure roll 102 shown in FIG. 4. Further, bearings 105*a*_2, which support the rotating shafts 106*b* protruding from the respective circular side surfaces of the roller body 106*a*, are formed on both sides of the opening 105*a*_1. Furthermore, shaft pressers 105*a*_3, which press the rotating shafts 106*b* supported by the respective bearings 105*a*_2, are formed at the upper portion of the duct 105*a*.

The duct 105*a* of this exemplary embodiment includes the upward opening 105*a*_1 facing the roller 106. As a result, air entering the internal space of the duct 105*a* directly ascends toward the opening 105*a*_1. A shape that is bent in the middle and opened sideways may also be considered as the shape of the duct 105*a*. However, air more easily ascends through the internal space in the duct 105*a* that includes the upward opening 105*a*_1 as described above. Therefore, according to the duct 105*a*, which includes the upward opening 105*a*_1, of this exemplary embodiment, the roller 106 is more reliably heated by the convection of the heated air as compared to a duct that is opened sideways.

Meanwhile, in the above-mentioned exemplary embodiment, a method of heating the roller 106 by not only the radiant heat from the heating roll 101 but also air, which is heated by the heating roll 101 and ascends due to convection, has been also actively employed as a method of heating the roller 106. For this reason, the duct 105*a* of which the lower end is opened toward the heating roll 101 and the upper end is opened upward is used to efficiently guide ascending air to the roller 106. However, a method of heating the roller 106 may be a method of heating the roller 106 by using radiant heat from the heating roll 101 as a main heat source without expecting air that ascends due to convection. In this case, a space has only to be formed between the roller 106 and the heating roll 101, and the space is not limited to the internal space of the above-mentioned duct. Further, a relative positional relationship between the roller 106 and the heating roll 101 is also not necessarily limited to a positional relationship where the heating roll 101 is positioned below the roller 106. As long as radiant heat from the heating roll 101 is transferred to the roller 106, the heating roll 101 may be positioned at any position.

Furthermore, the unitized fixing unit 100 has been exemplified above as an example of the fixing device or the fixing section of the invention. However, the fixing device or the fixing section of the exemplary embodiment of the invention is not limited thereto. The fixing device or the fixing section of the invention may be a non-unit type fixing device or fixing section, for example, a heating roll, a pressure roll, or the like may be directly supported by a frame of an image forming apparatus. In this form, the frame of the image forming apparatus corresponds to an example of the support member of the invention.

Moreover, the electrophotographic printer 10 has been exemplified above as the image forming apparatus according to the exemplary embodiment of the invention. However, the image forming apparatus according to the exemplary embodiment of the invention is not limited thereto, and may be, for example, a copying machine, a facsimile, or the like. Further, a fixing unit is not limited to the above-mentioned exemplary embodiment, and the fixing device may be other fixing units such as a flash fixing unit. Furthermore, as long as an image forming apparatus includes a heating fixing device, the image forming apparatus may be another image forming apparatus such as an inkjet type image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a first rotating member that rotates while pinching a sheet which holds an image on a first surface of the sheet and is transported, fixes the image to the sheet, and heats the image while coming into contact with the first surface;

a second rotating member that comes into contact with a second surface that is a back surface of the first surface;

a third rotating member that guides the sheet by rotating while coming into contact with the first surface of the sheet fed from a gap between the first and second rotating members, wherein the third rotating member is disposed at a bent corner of a transporting path for transporting the sheet; and a support member that has a duct that supports the third rotating member with a space through which the heat of the first rotating member is transferred to the third rotating member interposed between the first and third rotating members.

2. The fixing device according to claim 1, wherein the third rotating member includes a plurality of rolls that are rotationally driven while coming into contact with the sheet and are disposed at intervals in the width direction of the sheet, and the support member includes a plurality of pipelines which form mutually separated spaces between the first rotating member and the plurality of rolls and through which heat is transferred to the plurality of rolls, respectively.

3. The fixing device according to claim 2, wherein the plurality of pipelines include upward openings that face the rolls, respectively.

4. An image forming apparatus comprising:

an image forming section that forms an image on a first surface of a sheet and feeds the sheet to the downstream side; and a fixing section that receives the sheet and fixes the image to the sheet, the sheet holding the image, which is formed by the image forming section, on the first surface, wherein the fixing section includes a first rotating member that rotates while pinching the sheet fed from the image forming section, fixes the image formed on the sheet to the sheet, and heats the image while coming into contact with the first surface, a second rotating member that comes into contact with a second surface that is a back surface of the first surface, a third rotating member that guides the sheet by rotating while coming into contact with the first surface of the sheet fed from a gap between the first and second rotating members, wherein the third rotating member is disposed at a bent corner of a transporting path for transporting the sheet, and a support member that has a duct that supports at least the third rotating member with a space through which the heat of the first rotating member is transferred to the third rotating member interposed between the first and third rotating members.

5. The image forming apparatus according to claim 4, wherein the third rotating member includes a plurality of rolls that are rotationally driven while coming into contact with the sheet and are disposed at intervals in the width direction of the sheet, and the support member includes a plurality of pipelines which form mutually separated spaces between the first rotating member and the plurality of rolls and through which heat is transferred to the plurality of rolls, respectively.

6. The image forming apparatus according to claim 5, wherein the plurality of pipelines include upward openings that face the rolls, respectively.

* * * * *